US006698101B2

(12) United States Patent
Chen

(10) Patent No.: US 6,698,101 B2
(45) Date of Patent: Mar. 2, 2004

(54) LOW-VIBRATION AND LOW-NOISE GUIDE PLATE ASSEMBLY FOR A CHAIN SAW

(75) Inventor: Kuen-Yan Chen, No. 48, Hsi-An St., Feng-Yuan City, Taichung Hsien (TW)

(73) Assignee: Kuen-Yan Chen, Feng Yuan (TW)

( * ) Notice: Subject to any disclaimer, the term of this patent is extended or adjusted under 35 U.S.C. 154(b) by 53 days.

(21) Appl. No.: 10/091,832

(22) Filed: Mar. 5, 2002

(65) Prior Publication Data

US 2003/0167642 A1 Sep. 11, 2003

(51) Int. Cl.[7] ..... B27B 17/02
(52) U.S. Cl. ..... 30/387; 30/383
(58) Field of Search ..... 30/384, 383, 123.4

(56) References Cited

U.S. PATENT DOCUMENTS 5,845,402 A * 12/1998 Leini ..... 30/123.4

* cited by examiner

*Primary Examiner*—Douglas D. Watts
(74) *Attorney, Agent, or Firm*—Merchant & Gould, P.C.

(57) ABSTRACT

A guide plate assembly for a chain saw includes a middle plate that is sandwiched and fixed between two side plates so as to define a guide groove among outer peripheries of the middle plate and the side plates. A saw chain can run within the guide groove. The middle plate has a plurality of first holes formed therethrough. Each of the side plates has a plurality of second holes formed therethrough that are aligned and communicated with the first holes in the middle plate.

6 Claims, 6 Drawing Sheets

LOW-VIBRATION AND LOW-NOISE GUIDE PLATE ASSEMBLY FOR A CHAIN SAW

BACKGROUND OF THE INVENTION

1. Field of the Invention

This invention relates to a chain saw, and more particularly to a low-vibration and low-noise guide plate assembly for a chain saw, which includes a porous middle plate and two porous side plates that define a guide groove thereamong for running of an endless saw chain.

2. Description of the Related Art

Referring to FIGS. 1 and 2, a conventional chain saw 1 is shown to include a housing 2, a guide plate assembly 3, a driving gear 4, a guide sprocket 5, and a saw chain 6. The guide plate assembly 3 is connected fixedly to the housing 2, and has a middle plate 301 and two side plates 302. The middle plate 301 is sandwiched and fixed between the side plates 302. The outer peripheries of the middle plate 301 and the side plates 302 define a guide groove 303 thereamong for running of the saw chain 6 around the middle plate 301. The driving gear 4 is mounted rotatably on the housing 2. The guide sprocket 5 is mounted rotatably between the side plates 302. The saw chain 6 has a serrated inner peripheral portion 601 trained between the driving gear 4 and the guide sprocket 5, a plurality of aligned pairs of wings 602, and an outer peripheral saw blade unit 603. Each pair of the wings 602 are attached respectively to two opposite sides of the inner peripheral portion 601, and contact the outer peripheries of the side plates 302. As such, when the driving gear 4 rotates, the saw chain 6 runs within the guide groove 303 and around the middle plate 301.

The aforesaid conventional chain saw 1 suffers from the following disadvantages:

(1) There is no vibration-absorbing means associated with the guide plate assembly 3, thereby creating significant vibration of the saw chain 6 during operation that will result in loud noise, difficulty in handling the chain saw 1, and damage to the guide plate assembly 3 and the saw chain 6.

(2) Because the guide plate assembly 3 is relatively heavy, it is difficult to hold the chain saw 1 during operation.

SUMMARY OF THE INVENTION

An object of this invention is to provide a guide plate assembly for a chain saw, which has a vibration-absorbing design that can reduce the vibration of a saw chain.

Another object of this invention is to provide a lightweight guide plate assembly for a chain saw.

According to this invention, a guide plate assembly for a chain saw includes a middle plate that is sandwiched and fixed between two side plates so as to define a guide groove among outer peripheries of the middle plate and the side plates. A saw chain can run within the guide groove. The middle plate has a plurality of first holes formed therethrough. Each of the side plates has a plurality of second holes formed therethrough that are aligned and communicated with the first holes in the middle plate. Because the middle plate and the side plates are porous, they can absorb vibration transmitted from the saw chain during operation. Furthermore, the weight of the guide plate assembly is reduced due to the presence of the first and second holes.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
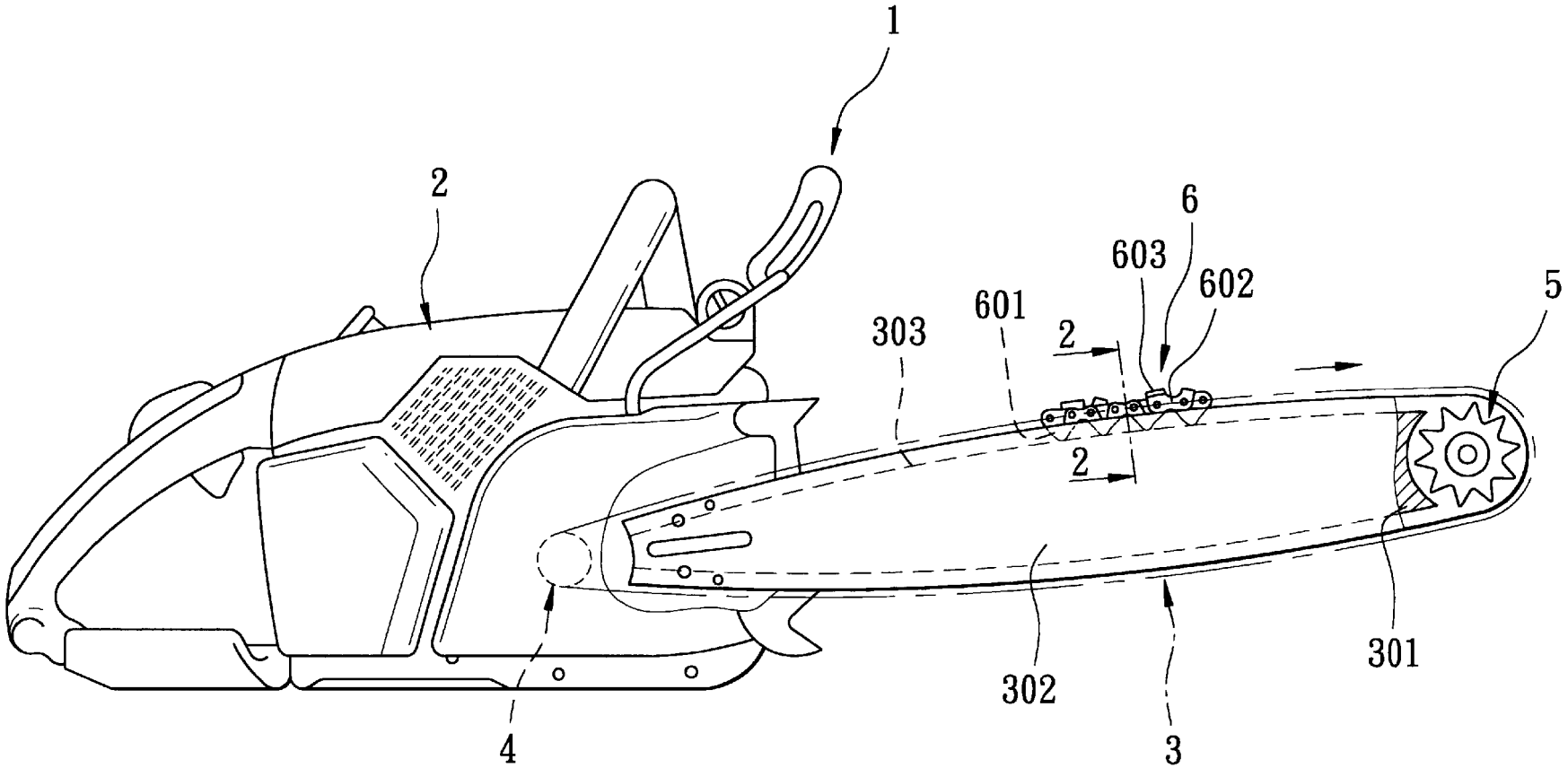
FIG. 1 PRIOR ART
FIG. 1 is a partly sectional, schematic view of a conventional chain saw.
Figure 2:
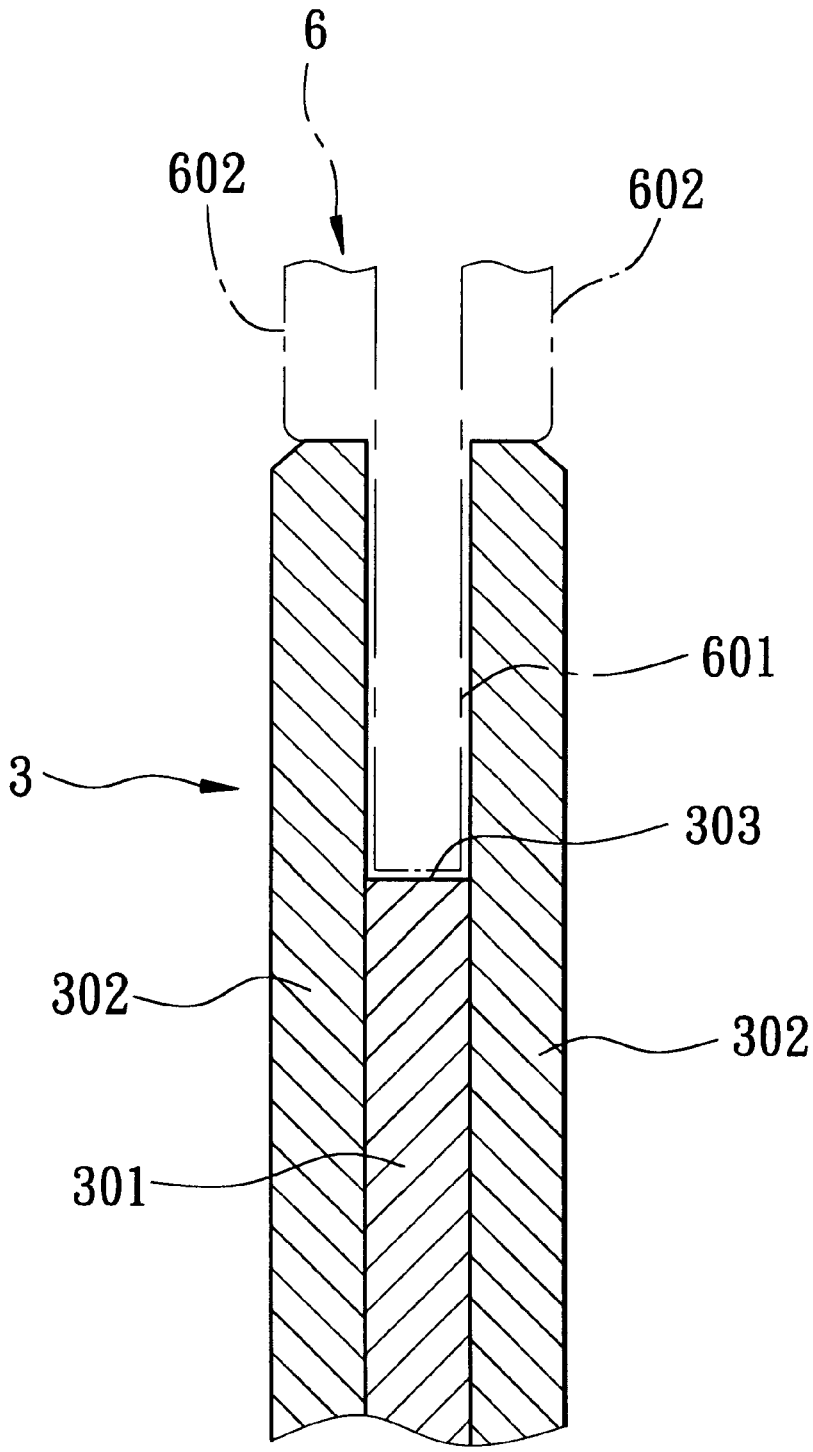
FIG. 2 PRIOR ART
FIG. 2 is a fragmentary sectional view of the conventional chain saw, taken along Line 2—2 in FIG. 1.
Figure 3:
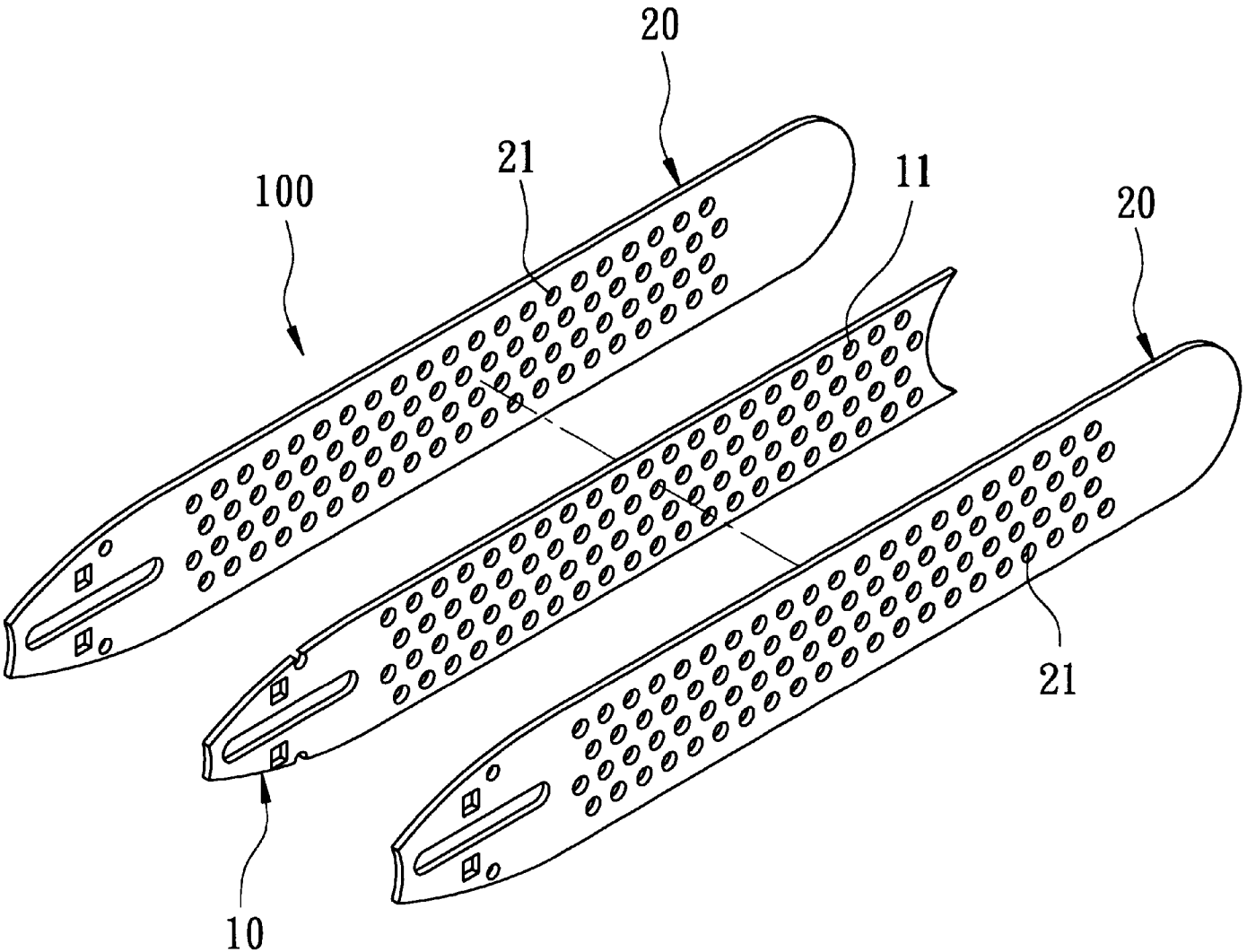
FIG. 3 is an exploded perspective view showing a first preferred embodiment of a guide plate assembly according to this invention.
Figure 4:
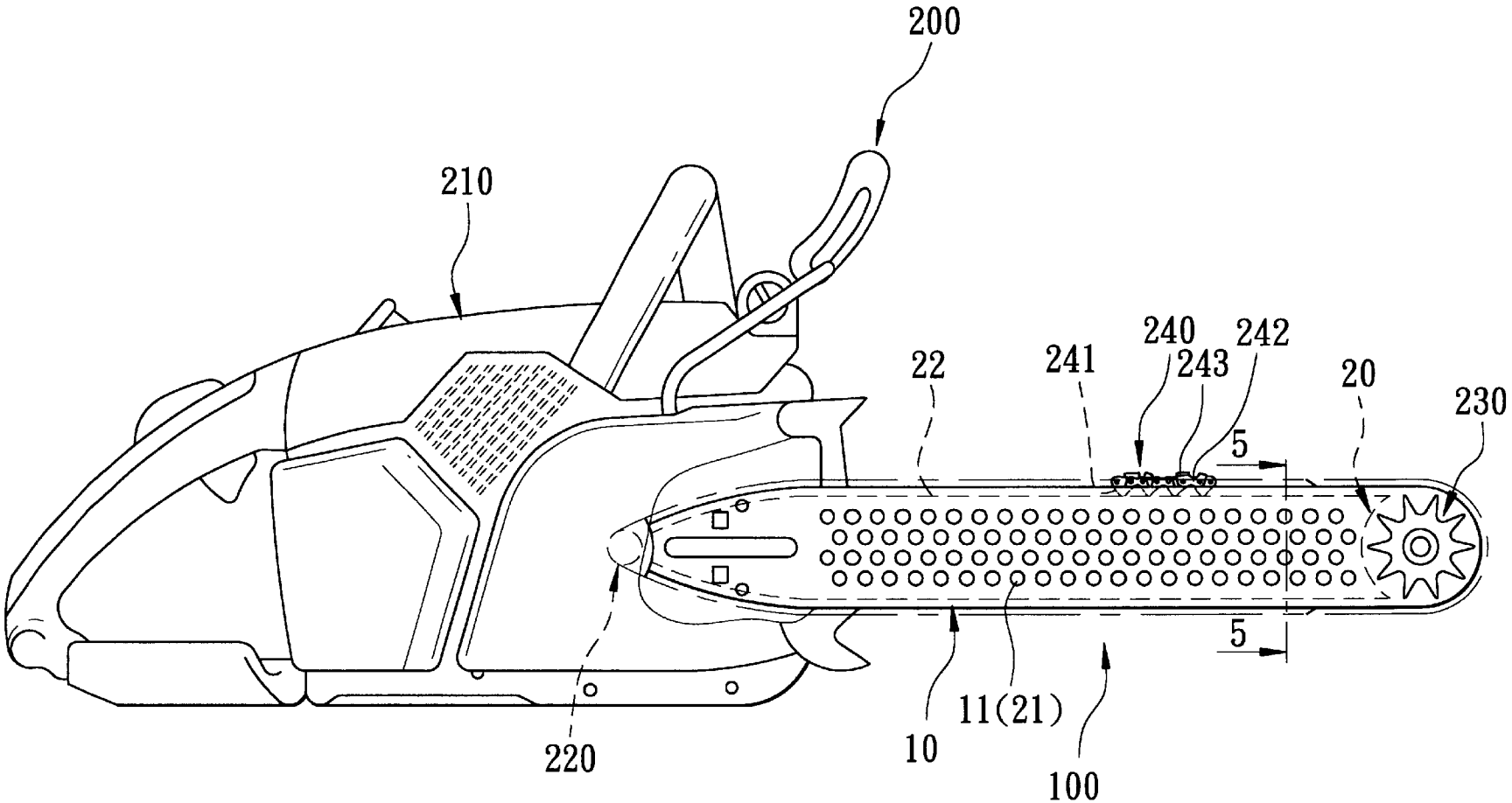
FIG. 4 is a schematic view of a chain saw, in which the first preferred embodiment is incorporated.
Figure 5:
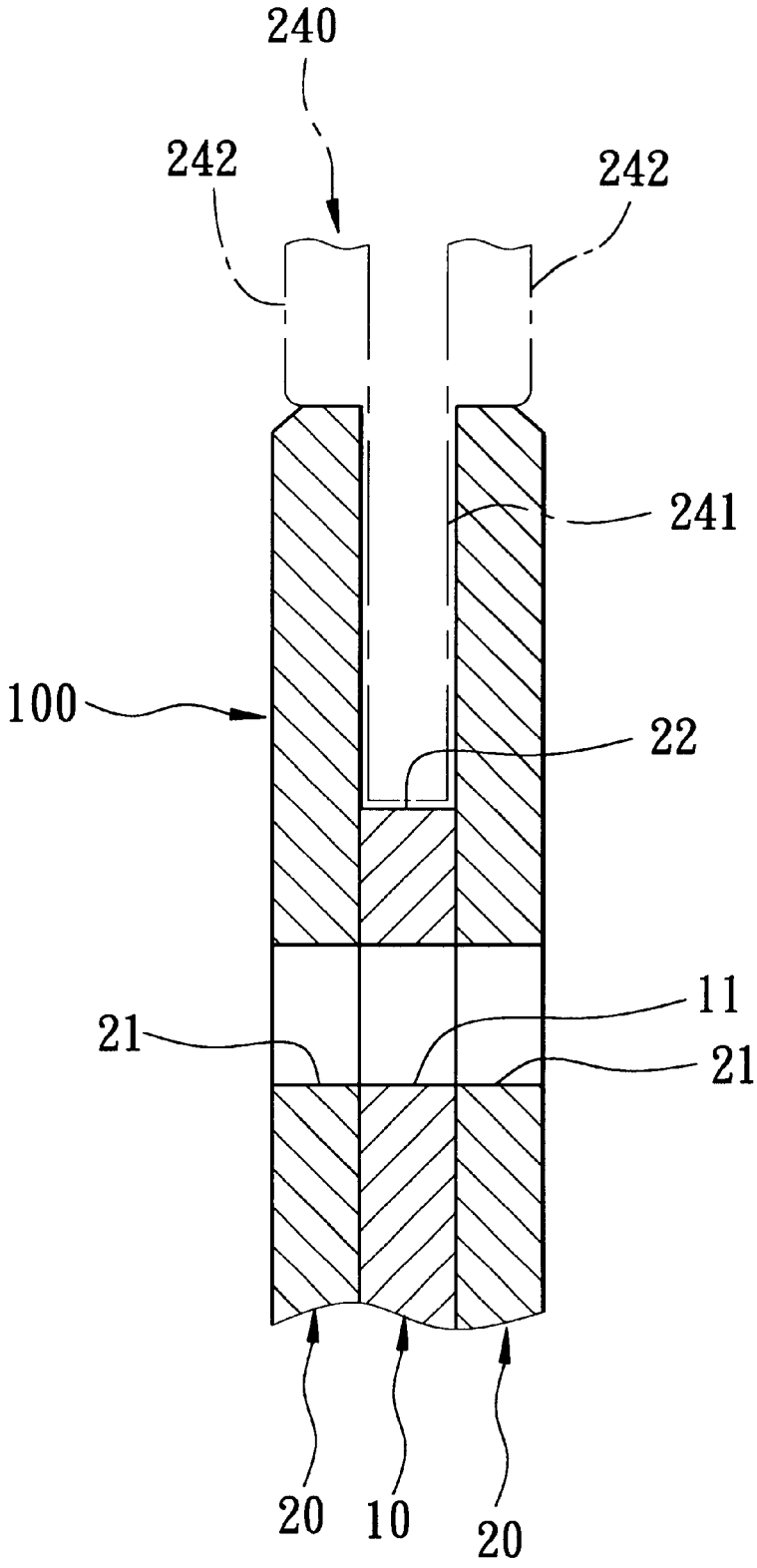
FIG. 5 is a fragmentary sectional view of the first preferred embodiment, taken along Line 5—5 in FIG. 4.

Referring to FIGS. 3, 4, and 5, a first preferred embodiment of a guide plate assembly 100 according to this invention is used in a chain saw 200, and is shown to include an elongated porous middle plate 10 and two elongated porous side plates 20. The middle plate 10 is sandwiched and fixed between the side plates 20. The chain saw 200 includes a housing 210, a driving gear 220 that is connected fixedly to the housing 210, a guide sprocket 230 that is mounted rotatably between the side plates 20, and an endless saw chain 240. The saw chain 240 has a serrated inner peripheral portion 241, a plurality of aligned pairs of wings 242, and a saw blade unit 243 connected fixedly to the wings 242. Each pair of the wings 242 are attached respectively to two opposite sides of the inner peripheral portion 241, and contact outer peripheries of the side plates 20 of the guide plate assembly 100, as shown in FIG. 5.

The guide plate assembly 100 is connected fixedly to the housing 210. The middle plate 10 has a plurality of first holes 11 formed therethrough, which have a circular cross-section and which are arranged in four longitudinal rows. The first holes 11 of each adjacent pair of rows are staggered along a longitudinal direction of the middle plate 10. Each of the side plates 20 also has a plurality of second holes 21 that have a circular cross-section, that are arranged in four longitudinal rows, and that are aligned and communicated with the first holes 11 in the middle plate 10. The second holes 21 of each adjacent pair of rows are staggered along a longitudinal direction of the side plates 20. A guide groove 22 is defined among the outer peripheries of the middle plate 10 and the side plates 20 so as to confine the inner peripheral portion 241 of the saw chain 240 therein, as shown in FIG. 5.

Because the middle plate 10 and the side plates 20 are porous, they can absorb vibration transmitted from the saw chain 240 during operation, thereby resulting in effective reduction of noise and prolongation of the service time of the saw chain 240 and the guide plate assembly 100.

Furthermore, handling of the chain saw 200 can be conducted with relative ease due to smooth and quiet movement of the saw chain 240 on the guide plate assembly 100.

In addition, because the guide plate assembly 100 is relatively lightweight due to the presence of the first and second holes 11, 21, the chain saw 200 can be held easily during a cutting operation.

Figure 6:
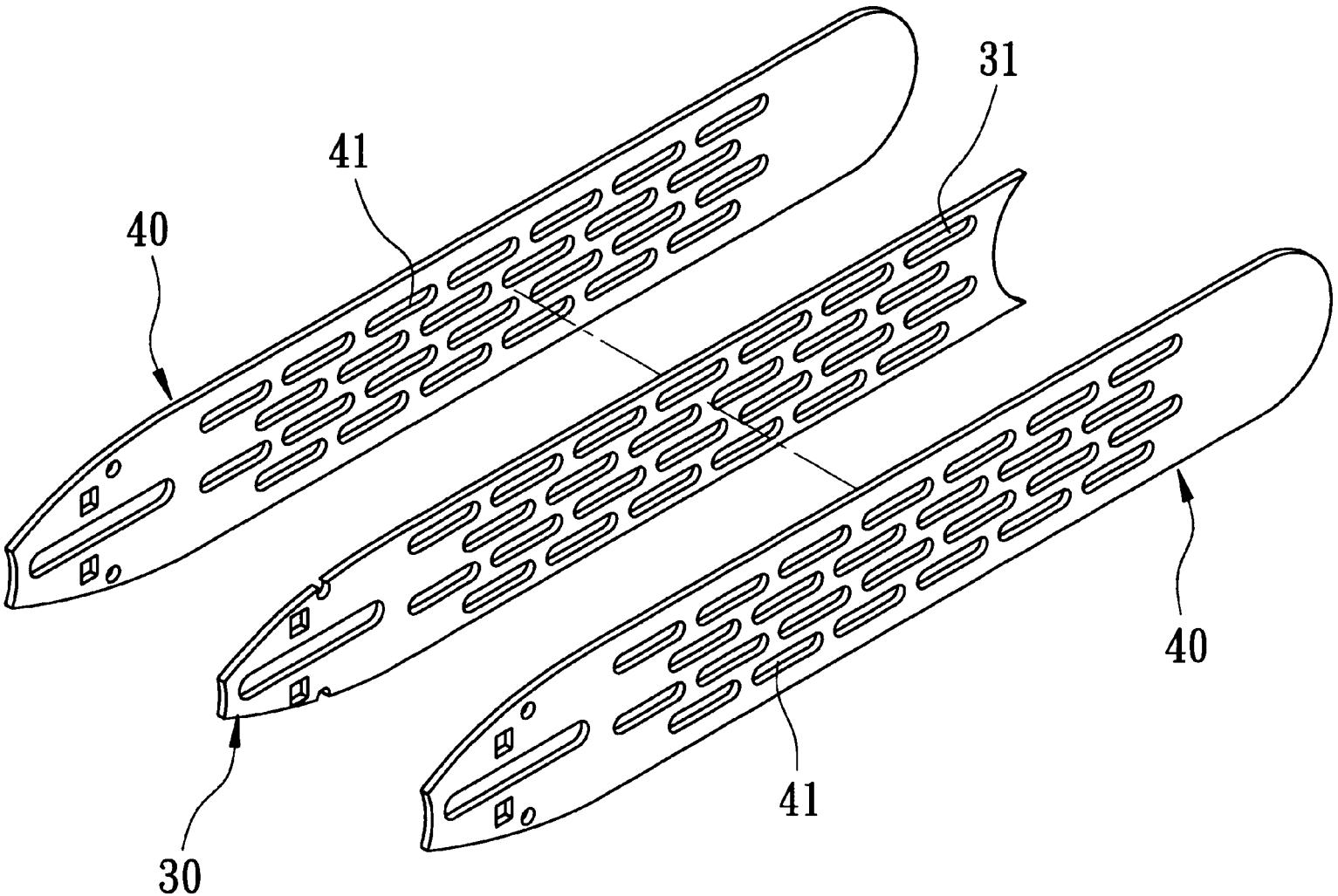
FIG. 6 is an exploded perspective view showing a second preferred embodiment of a guide plate assembly according to this invention.

FIG. 6 illustrates a second preferred embodiment of this invention, which is similar to the first preferred embodiment in construction except that the first and second holes 31, 41 of the middle plate 30 and the side plates 40 have an elongated cross-section.

With this invention thus explained, it is apparent that numerous modifications and variations can be made without departing the scope and spirit of this invention. It is therefore intended that this invention be limited only as indicated by the appended claims.

I claim:

1. A guide plate assembly for a chain saw, the chain saw including a housing which is connected fixedly to said guide plate assembly, and an endless saw chain which runs around said guide plate assembly and which has a serrated inner peripheral portion, a plurality of aligned pairs of wings, and an outer peripheral saw blade unit, each pair of the wings being attached respectively to two opposite sides of the inner peripheral portion, said guide plate assembly comprising:

a middle plate having a plurality of first holes formed therethrough and that is adapted to permit the saw chain to be sleeved thereon; and two side plates, said middle plate being sandwiched and fixed between said side plates so as to define a guide groove among outer peripheries of said middle plate and said side plates, said guide groove being adapted to confine the inner peripheral portion of the saw chain therein, each of said side plates having a plurality of second holes formed therethrough, said second holes being aligned and communicated with said first holes, respectively;

wherein said middle plate is elongated, said first holes being arranged in a plurality of longitudinal rows, said first holes in each adjacent pair of said rows being staggered along a longitudinal direction of said middle plate.

2. The guide plate assembly as claimed in claim 1, wherein said first and second holes have a circular cross-section.

3. The guide plate assembly as claimed in claim 1, wherein said first and second holes have an elongated cross-section.

4. A guide plate assembly for a chain saw, the chain saw including a housing which is connected fixedly to said guide plate assembly, and an endless saw chain which runs around said guide plate assembly and which has a serrated inner peripheral portion, a plurality of aligned pairs of wings, and an outer peripheral saw blade unit, each pair of the wings being attached respectively to two opposite sides of the inner peripheral portion, said guide plate assembly comprising:

a middle plate having a plurality of first holes formed therethrough and that is adapted to permit the saw chain to be sleeved thereon; and two side plates, said middle plate being sandwiched and fixed between said side plates so as to define a guide groove among outer peripheries of said middle plate and said side plates, said guide groove being adapted to confine the inner peripheral portion of the saw chain therein, each of said side plates having a plurality of second holes formed therethrough, said second holes being aligned and communicated with said first holes, respectively;

wherein said side plates are elongated, said second holes being arranged in a plurality of longitudinal rows, said second holes in each adjacent pair of said rows being staggered along a longitudinal direction of said side plates.

5. The guide plate assembly as claimed in claim 4, wherein said first and second holes have a circular cross-section.

6. The guide plate assembly as claimed in claim 4, wherein said first and second holes have an elongated cross-section.

* * * * *